United States Patent [19]

Canals et al.

[11] 4,302,907

[45] Dec. 1, 1981

[54] SELECTIVELY INTERLOCKED DOUBLE SECURITY DOORS

[76] Inventors: José M. Canals; Ramón M. Canals, both of Virgen del Pilar 32, Tarrasa (Prov. Barcelona), Spain

[21] Appl. No.: 82,362

[22] Filed: Oct. 5, 1979

[30] Foreign Application Priority Data

| | | | |
|---|---|---|---|
| Oct. 13, 1978 | [ES] | Spain | 474.204 |
| May 25, 1979 | [ES] | Spain | 480.942 |
| May 25, 1979 | [ES] | Spain | 480.943 |

[51] Int. Cl.[3] ..... E05B 65/04; E05C 7/02

[52] U.S. Cl. ..... 49/65; 49/67; 49/163; 292/DIG. 17; 292/150

[58] Field of Search ..... 49/65, 67, 163, 168; 292/DIG. 17, DIG. 21, 150

[56] References Cited

U.S. PATENT DOCUMENTS

| | | | |
|---|---|---|---|
| 2,177,617 | 10/1939 | Hinton | 49/65 X |
| 2,537,896 | 1/1951 | Hinton et al. | 49/65 X |
| 2,640,720 | 6/1953 | Brown | 292/150 |
| 3,722,237 | 3/1973 | Taylor | 49/65 X |

*Primary Examiner*—Philip C. Kannan

*Attorney, Agent, or Firm*—Sughrue, Mion, Zinn, Macpeak and Seas

[57] ABSTRACT

A personal security door arrangement constituted by the juxtaposition of two doors, which may be coupled together at will, in one same frame in an opening, the outer door affording complete visibility and, possibly, the passage of small objects, while the inner door is conventional. Said doors are hingedly mounted to the frame on the same side, rotate in the same direction and have interrelated lock arrangements.

9 Claims, 15 Drawing Figures

SELECTIVELY INTERLOCKED DOUBLE SECURITY DOORS

FIELD OF THE INVENTION

The present invention relates to a personal security door arrangement, and more particularly to a door arrangement comprising the juxtaposition of two doors, which may be coupled together at will, wherein the opening of the inner door does not open the outer door, it being necessary to actuate a coupling device from the inside. This will be done after the person requesting entry has been fully observed, so that the power to admit remains in the hands of the person on the inside, whereas the person on the outside may not fulfil his intentions either by his own means or by intimidation.

SUMMARY OF THE INVENTION

In the door opening there is disposed a conventional inner door juxtaposed to an outer protective door affording complete visibility therethrough and, possibly, allowing the passage of small objects, said doors being hingedly mounted to the frame on the same side, rotating in the same direction and each having its own lock and having:

(a) mutual coupling means for the two doors, with actuating means for the outer door from the inner door, interlockable by hand and automatically releasable on closing the door, which means, after the inner door has been opened to observe the caller and has, of necessity, been closed again, are actuated voluntarily, thereby opening and retaining the outer door lock and opening both doors together;

(b) interlocking means for the coupling means mounted in the inner door;

(c) retaining means holding both doors coupled together in the open position;

(d) releasing means automatically disengaging both doors on their being closed;

(e) an outer door blocking means, blocking the bolts of the lock thereof when the inner door is open.

The coupling means for the doors comprise a shaft crossing through the inner door and having a control actuatable from the inside and a terminal portion with a radially extending arm on the outside facing and penetrating in an orifice having a radially extending notch in the outer door, which terminal portion, on penetrating in the said orifice, engages a lever actuating the said outer door lock.

A further feature of the invention is that the inner door coupling means interlocking means comprises a control adapted to act on a double catch finger device mounted to the coupling means shaft, one of said catch fingers engaging a lever coupled to a lock capable of being opened from the outside by the corresponding key, said control activating the coupling means at will.

Yet a further feature of the invention is that the retaining means comprises a rocking lever having a cam tooth actuatable by the releasing means and which engages the inner door interlocking double catch finger device, thereby setting said catch fingers in the door coupling operative position.

A further feature of the invention is that the releasing means comprises a member which, by the closing movement of the inner door, inactivates the retaining means, thereby releasing the coupling means.

Yet a further feature of the invention, according to a preferred embodiment, is that the releasing means comprises a rod disposed in the inner door, having a spring biassing the rear end thereof in engagement with the door jamb, and being at the front end thereof with a crank carrying a pawl acting on the releasing means rocking lever cam only when the said door is being closed, in which case the rod moves forward and inactivates said rocking lever with respect to the interlocking means catch finger device.

Another feature of the invention is that the coupling means shaft terminal portion is provided with a recess in which there is insertable a rotatable rod of the outer door lock, the rotation of said rod causing opening of the said lock from the inner door.

Yet another feature of the invention is that the outer door blocking means comprises one or more latch bolts attached to an operating member mounted in the door itself and a further operating member blocking member, mounted on the hinge bearing jamb of the door frame and engaging an inner door hinge portion, said blocking member being pushed, when the inner door is opened, by said hinge portion, thereby blocking said outer door operating member and preventing the latches thereof from being opened.

A final feature, according to a preferred embodiment, is that the outer door blocking means, comprises an operating member constituted by a rod attached to one or more latch bolts and having a biassing spring and mating longitudinally with a bore in the hinge bearing jamb, there being mounted on the same jamb a blocking member constituted by a further rod perpendicular to the former and having a spring biassing it against the inner door moving hinge portion and mating longitudinally with a rear bore in the frame, the said moving hinge portion having a cam portion which, in the open position of the inner door, bears against the said rod, preventing movement of the outer door latch rod.

Further features and objects of the invention will be disclosed in detail in the following description, with reference to the accompanying illustrative drawings in which:

DESCRIPTION OF THE PREFERRED EMBODIMENTS

Figure 1:
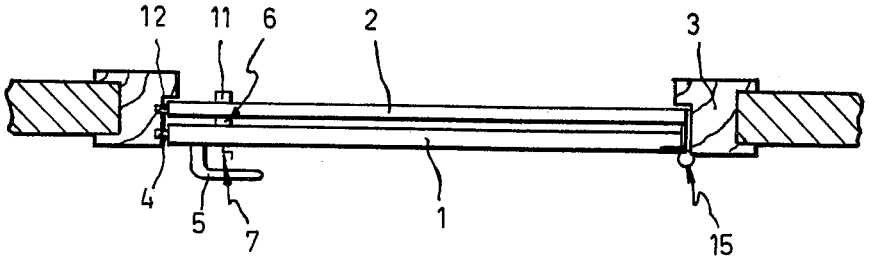
FIGS. 1 to 3 are simplified plan views of the three relative positions characteristic of the inner and outer doors forming a security door according to the invention.

The personal security door arrangement of the invention comprises a conventional inner door 1 and a protective outer door 2, which affords full vision to the outside, both doors being hingedly mounted to the same jamb 3 of the door frame. As may be seen in FIGS. 1 to 3, the inner door 1 is of normal construction, with a latch bolt 4 operated by a door handle 5, the lock bolt having been omitted for simplification of the drawing. The inner door is provided with means 6 for coupling it to the outer door 2, interlocking means 7, retaining means 8 and releasing means 9.

The outer door 2 is of a special grille, glazed or similar construction and may be provided with openings 10 which, apart from facilitating a view of the outside, allow the passage of small objects with the door closed. The door 2 is provided with lock 13 having a latch bolt 12 operated by a cylinder 11, provided with a polygonal shaped rod 14 on the inner surface thereof.

Figure 4:
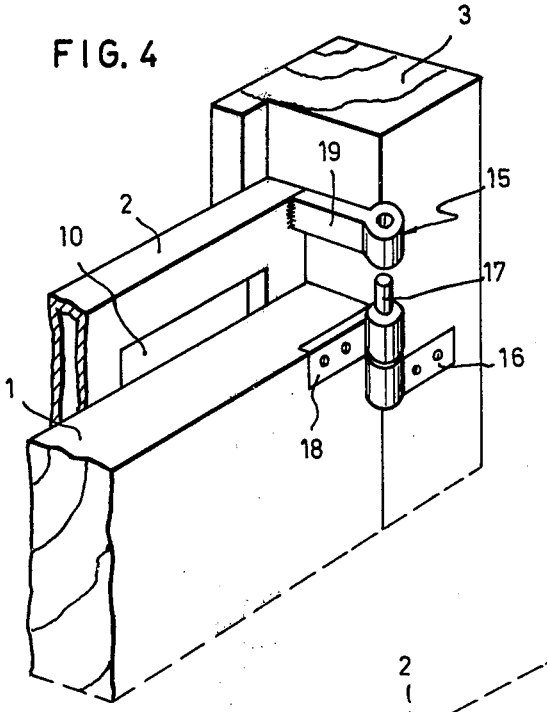
FIG. 4 is a perspective view of a set of hinges for the inner and outer doors.

The said doors 1 and 2, as illustrated in FIG. 4, are mounted to the frame 3 by sets of hinges 15, formed by a common support 16 and male pivot 17, on which there are seated an arm 18 for the inner door 1 and an arm 19 for the outer door 2.

Figure 7:
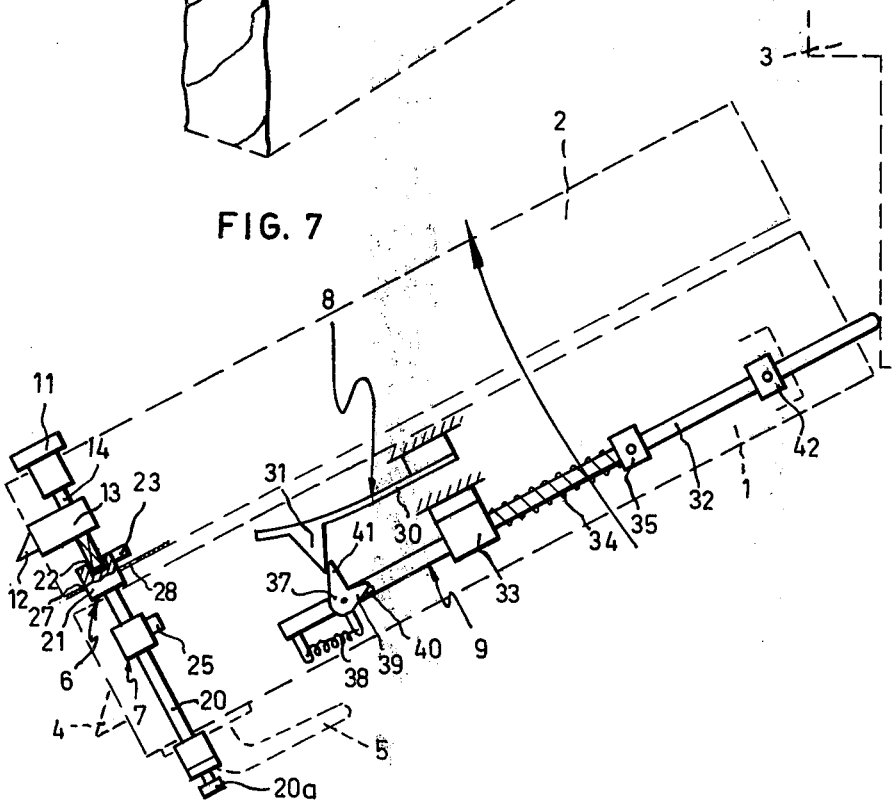
FIG. 7 is a view similar to FIG. 5, showing the closing stage, with both doors coupled together.
Figure 5:
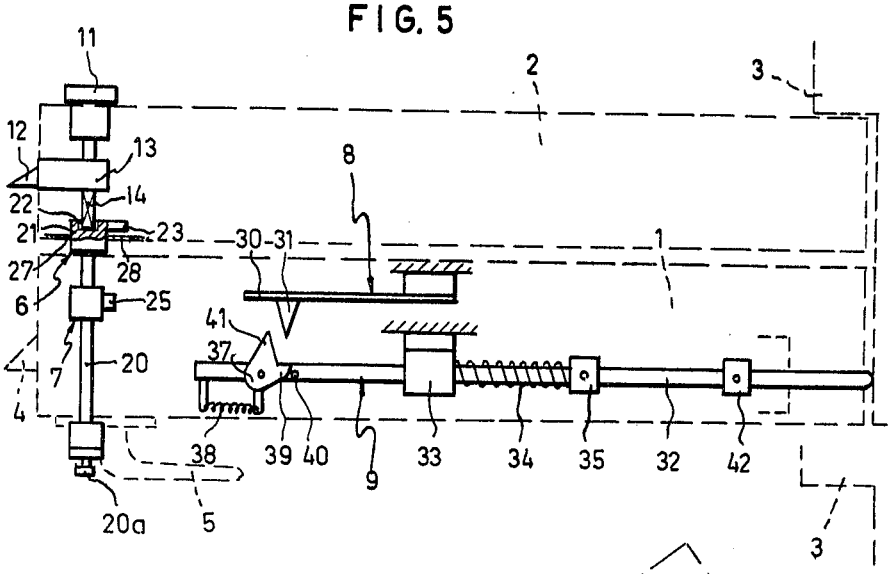
FIG. 5 is a diagrammatic plan view of a security door arrangement according to the invention in the door closed position.
Figure 6:
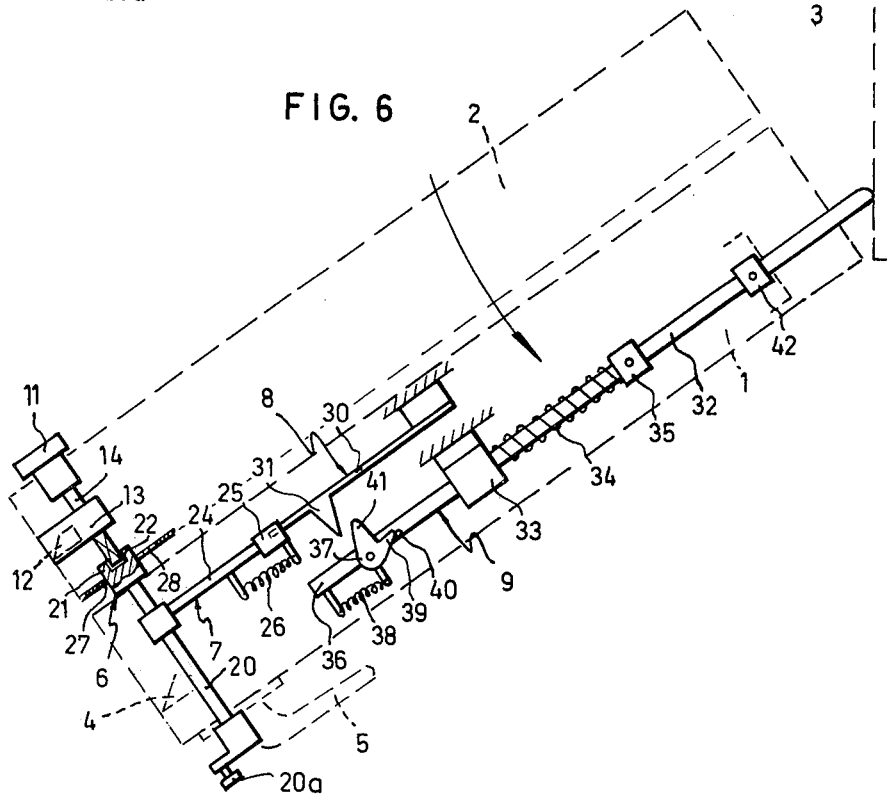
FIG. 6 is a view similar to FIG. 5, showing the opening stage of the security door, both doors being coupled together.
Figure 8:
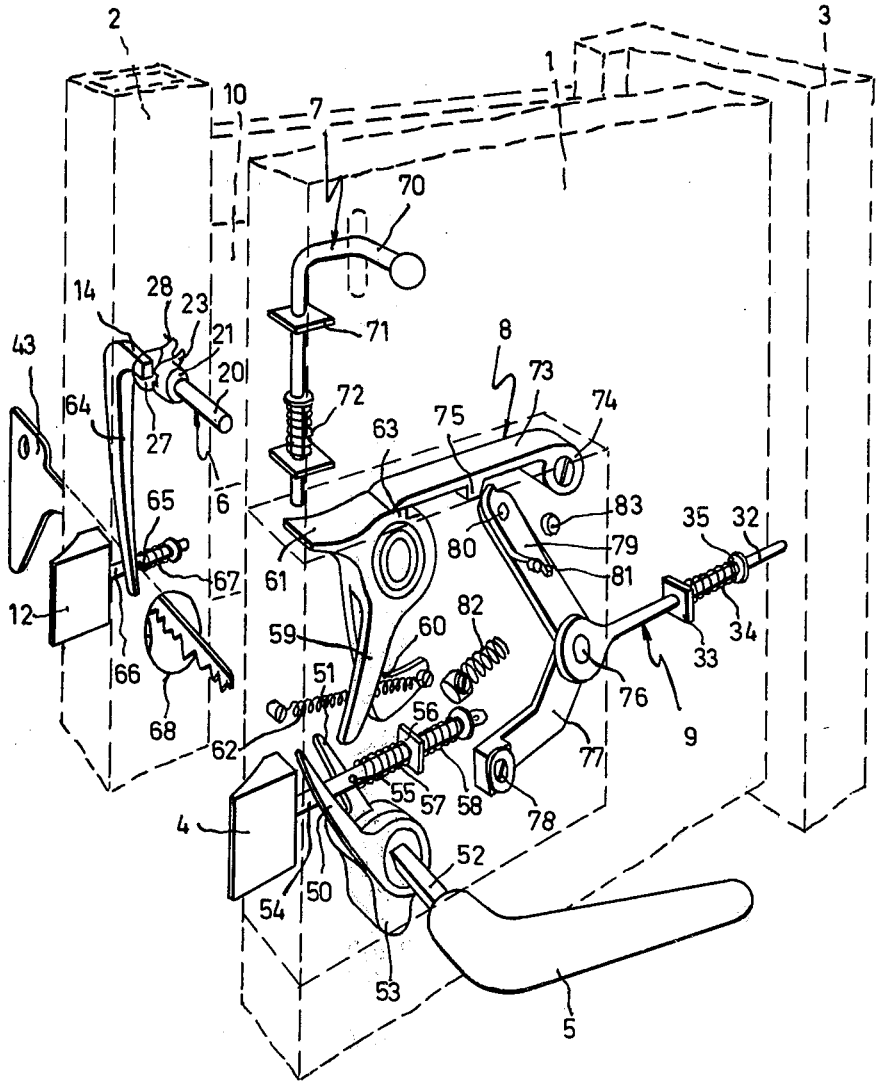
FIG. 8 is a perspective view illustrating a preferred embodiment of the mechanical components of the coupling, interlocking, retaining and blocking means of the security door arrangement of the invention.
Figure 9:
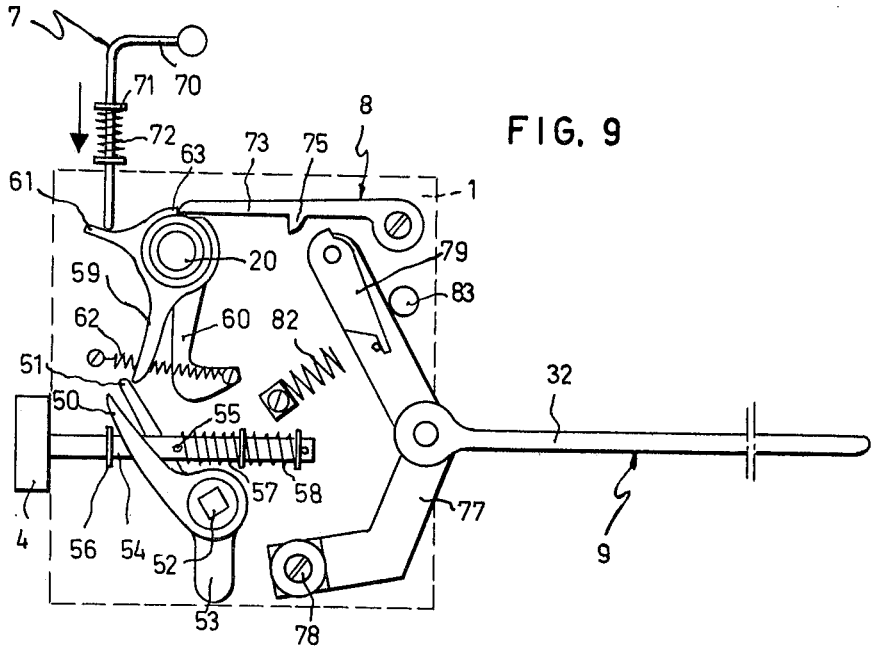
FIG. 9 illustrates the means shown in FIG. 8, located in the inner door, in the interlocking stage of the coupling means for later operation by way of the door handle.

The mutual relationship between the said doors 1 and 2, in the embodiment of FIGS. 5, 6 and 7, is attained by the coupling means 6. This means comprises a shaft 20 crossing through the inner door 1 and provided with a terminal portion 21 having a recess 22 for receiving the rod 14, and a radially extending arm 23.

The said coupling means 6 is actuated by the interlocking means 7, which is constituted, as shown in FIG. 6 by an intermediate lever 24 mounting a unidirectionally articulated rocker arm 25 pulled by a recovery spring 26, all fixedly attached to the shaft 20 and actuated by a crank 20*a*. The lever 24 is not visible in FIGS. 5 and 7 as its extends downwardly into the drawings while the handle or lever arm of crank 20*a* extends upwardly out of the drawings.

On the other hand, there is disposed in the outer door 2, concentrically with the rod 14, an opening 27 having a radially extending notch 28 facing the terminal portion 21 in such a way that in the closed position of the inner door 1, the radially extending arm 23 of the coupling means 5 coincides with the said radially extending notch 28 and the recess 22 fits over the rod 14.

The retaining means 8, in the embodiment of FIGS. 5, 6 and 7, is comprised of a flexible leaf spring 30, on which said rocker arm 25 may rest, and which is provided with a cam 31 engageable by the releasing means 9.

The releasing means 9, located in the inner door 1 to inactivate the retaining means 7, is comprised of a sliding rod 32, horizontally disposed in a support 33 and having its rear end biassed against the door jamb 3 by a spring 34 in engagement with a stop 35. Said rod 32 is provided with a head portion 36 carrying a pawl 37 attracted by a spring 38 and having an arm 39 biassed against a stop 40 on the head portion 36 and a further arm 41 engageable with the cam 31 of the retaining means 8. An adjustable stop member 42 allows the range of movement of the rod 32 within the door to be adjusted.

Figure 2:
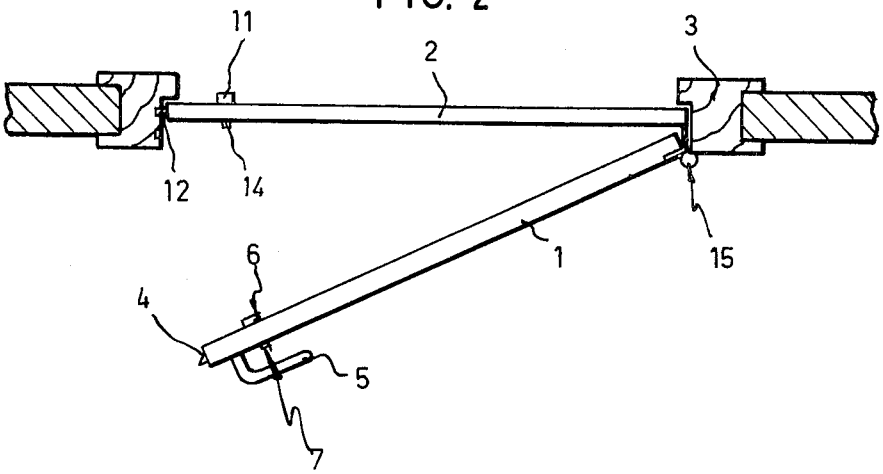
Figure 3:
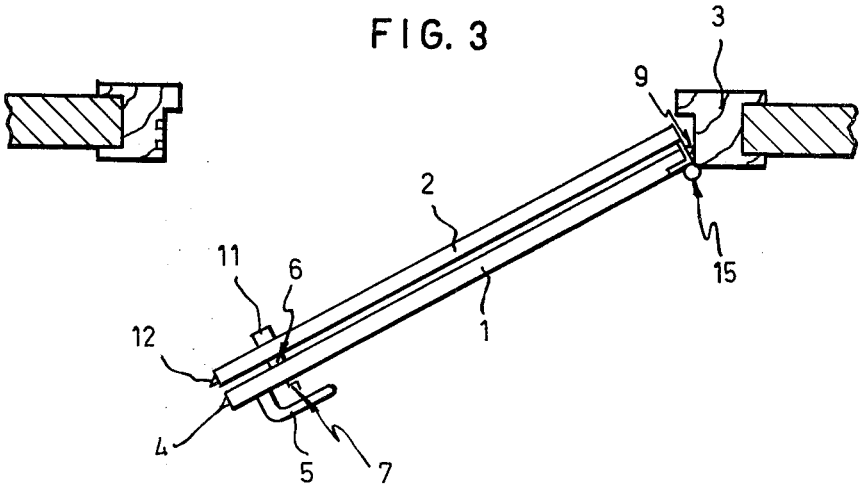

In the normal closed position of the doors 1 and 2, as seen in FIG. 5, the terminal portion 21 and arm 23 of the coupling means are inserted in the door 2 through the opening 27 and notch 28 thereof and in turn, the rod 14 is inserted on the recess 22. On receipt of a call from the outside, the inner door 1 is opened by way of the handle 5, as shown in FIG. 2, with the outer door 2 remaining closed, which enables the person calling to be recognised, a conversation to be held or, as the case may be, money, documents or other small objects to be handed over or exchanged through the openings 10 formed between the bars of the grille forming the said door 2. If it is wished to allow the caller in, the inner door 1 must be reclosed, the crank 20*a* must be rotated as illustrated in FIG. 6 so that the coupling means 6 function in such a way as for the shaft 20 to locate the arm 23 out of the notch 28, inside the inner door, the latch of the inner door 1 being opened, whereby the rod 14 is rotated to open the latch 12 of the lock 13, at the same time as the outer door 2 is pulled open, as illustrated in FIGS. 3 and 6.

The opening of the doors 1 and 2 from the outside is feasible by a key for the cylinder 11 of the lock 13 in the outer door 2, in the cases illustrated in FIGS. 5, 6 and 7 and by another key for the latch 4 lock of the inner door 1.

The purpose of the retaining means 8 is to hold the coupling means 6 in the operative position thereof. In the coupling position for the opening of the doors 1 and 2, the lever 24 has been rotated by the shaft 20 whereby the rocker arm 25, overcoming the bias of the spring 26, rides over the leaf spring 30, as observed in FIG. 6. This position is held while the doors 1 and 2 are being opened together. When the doors are being closed, as illustrated in FIG. 7, the rod 32 is pushed by the frame 3, thereby pushing the pawl 37, rigid in this direction, against the leaf spring 30, by the arm 41 which presses the cam 31, causing lateral flexing of the leaf spring 30 to release the rocker arm 25 and, consequently, the lever 24, as illustrated in FIG. 7, whereby the shaft 20, under the bias of the spring of lock 13 rotates to place the coupling arm 23 in the release position relative to the opening 27 of the outer door 2.

FIGS. 8, 9, 10, 11 and 12 illustrate a particular preferred embodiment of the security door arrangement mechanisms, in which the retaining means 8 have, on the one hand, two levers 50 and 51 mounted on the sprindle 52 of the lock 53 situated in the inner door, allowing the bolt 54 of the latch 4 to be moved via a fixed pin 55. Said bolt 54 is supported and guided by supports 56 and is provided with a pair of springs 57 and 58.

The levers 50 and 51 act on a pair of catch fingers 59 and 60 mounted on a core portion on the shaft 20 of the coupling means 6 and engage the interlocking means 7 through an arm 61, having a recovery spring 62 and a detent 63 on the core portion. The said shaft 20 carries the terminal member 21 with radially extending arm 23 and recess 22 for coupling in the opening 27 and with the rod 14 of the outer door, as has been previously explained. In this embodiment, the rod 14 is attached to a lever 64 engageable with a pin 65 of the bolt 66 of the latch 12, the bolt being provided with a recovery spring 67.

The outer door 2 is provided with an opening 68 for the passage of a key 43, for the purpose of opening the lock 53 of the inner door 1.

Also, on the other hand, the retaining means 8 is provided with a rocker lever 73 mounted on a shaft 74 and provided with a cam tooth 75 and is engageable with the detent 63 of the core portion.

Said interlocking means 7 is provided with a manually operated control 70 mounted in brackets 71 and having a recovery spring 72, which is engageable with the arm 61 to locate the coupling means 6 in the operative position thereof, in which the arm 23 rotates and is retained in the opening 27 as having been rotated beyond the notch 28. Said manual control 70 may be replaced by any other device having the same effect, such as a push button combined with a rocking member engageable with the arm 61.

The releasing means 8 is composed of the horizontal sliding rod 32 previously described, which is provided with a terminal portion jointed at 76 to a crank 77 capable of rocking around one end 78 and carrying at the other end thereof a pawl 79 rotatable around a point 80, the movement of said pawl being limited by a stop member 81, said pawl being engageable with the cam tooth 75 of the retaining means 8. A spring 82 damps the movements of the crank 77 and a stop member 83 limits the movement thereof.

In the present embodiment, the behaviour of the security door arrangement is the same as described hereinbefore. When the inner door 1 is to be opened and the outer door 2 is to remain closed, it is only necessary to rotate the handle 5 whereby the latch 4 of the inner door 1 is withdrawn and the inner door may be opened, while the outer door 2 remains closed.

When it is desired to open both doors 1 and 2 together, the inner door 1 must of necessity be closed, in which case the combined door may be opened from the inside or from the outside.

Figure 10:
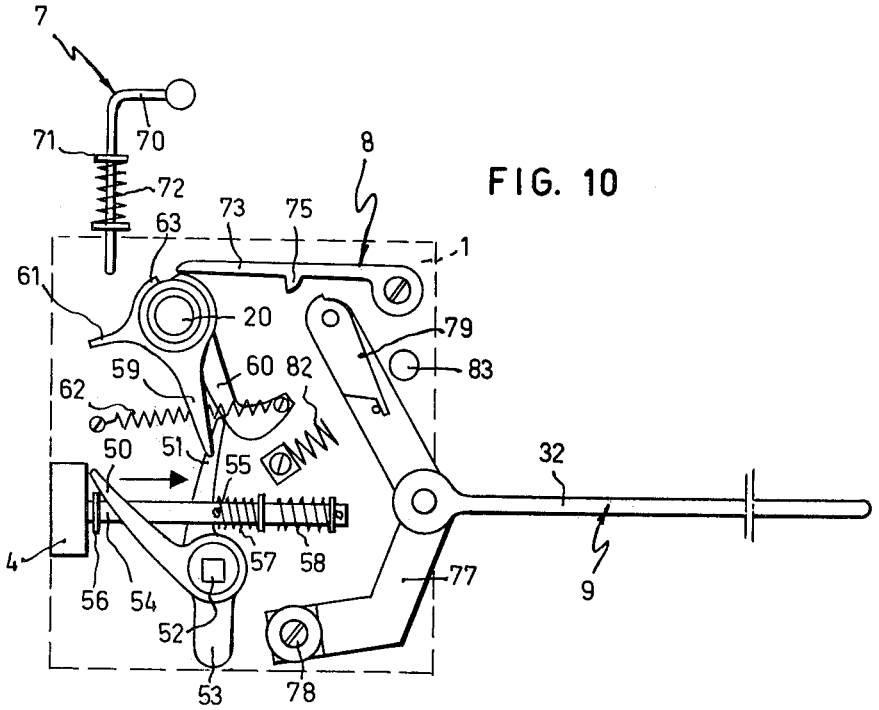
FIG. 10 is a view of the FIG. 9 members, illustrating operation of the coupling means by way of a key from the outside.

If the combined door is to be opened from the outside, as illustrated in FIG. 10, the lock 53 of the inner door 1 is operated by the key 43, whereby the lever 51 draws with it the latch 4 and actuates the catch finger 60, thereby coupling the doors together by way of the shaft 20, arm 23, opening 27 and rod 14, which actuates the latch 12 via the lever 64.

Figure 11:
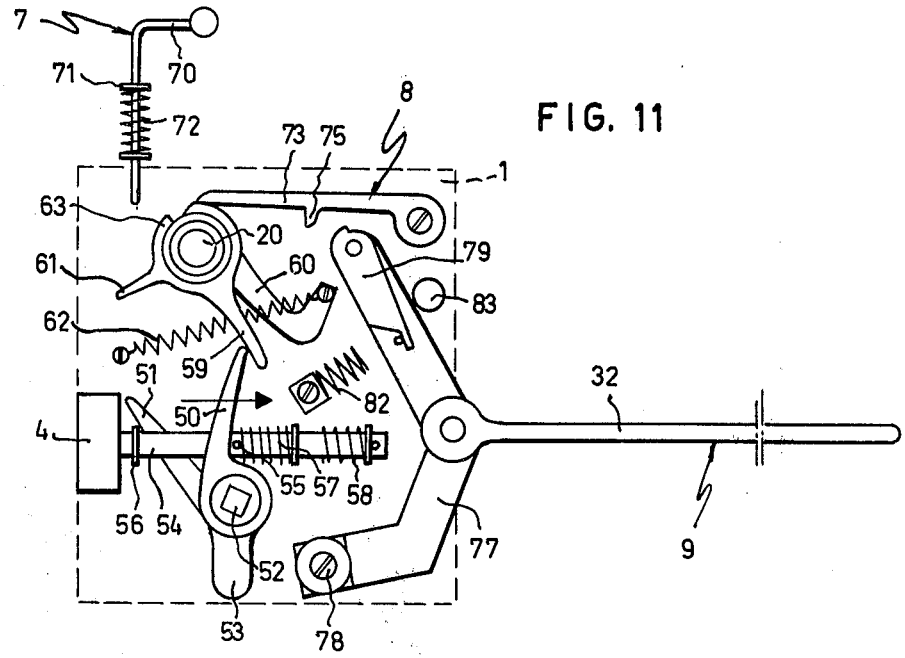
FIG. 11 is a view similar to FIG. 9, in which the coupling means are being operated by the inner door handle, thereby opening the door latches.

If the combined door is to be opened from the inside, the control 70 must be actuated to locate catch finger 59 in the path of the lever 50 actuated by the handle 5. In such situation, see FIG. 9, the doors have been coupled together by rotation of the shaft 20 and, in the same way as described hereinbefore, the combined door may be opened by actuation of the handle 5, as seen in FIG. 11.

Figure 12:
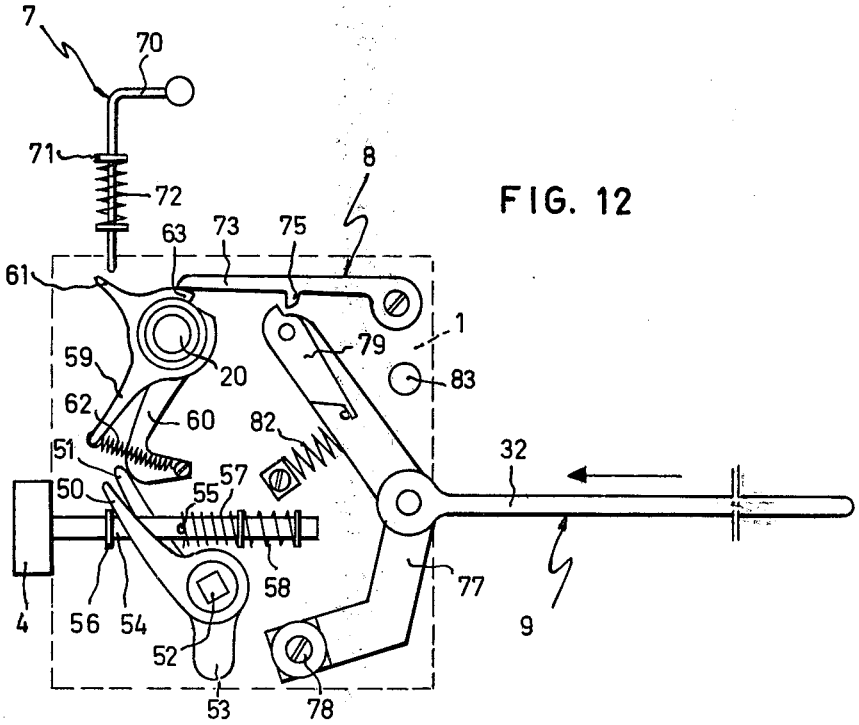
FIG. 12 is a view similar to FIG. 9 wherein the coupling means have been automatically released by the releasing means.

When the combined door is closed, the rod 32 of the releasing means 9 is pushed by the door jamb 3, raising thereby the crank 73 and releasing the core portion of the catch fingers 59 and 60 as seen in FIG. 12, whereby the mechanism is positioned to allow the combined door to be opened by the key 43 from the outside, or the inner door 1 alone from the inside by the handle 5.

Figure 13:
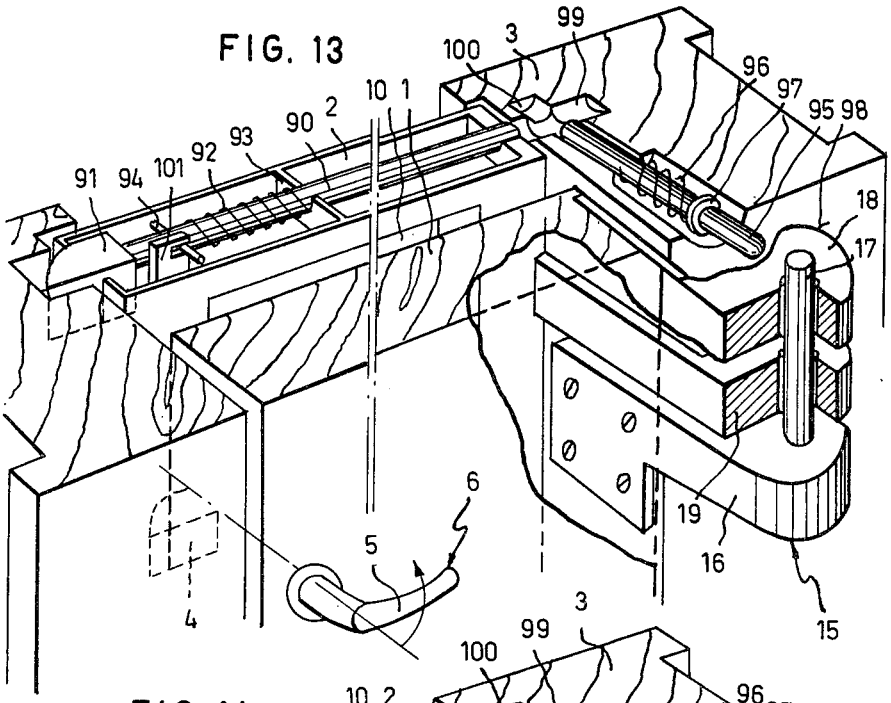
FIG. 13 is a partial, perspective view of the set of doors comprising the security door arrangement, having outer door blocking mechanism in the door closed position.

The mechanism comprises, as seen in FIG. 13, a rod 90 housed along the top of the outer door 2 and being provided with a latch 91 and a biassing spring 92 bearing against a wall 93 and a pin 94 and a further rod 95, housed across the fixed door jamb 3 and provided with a biassing spring 96 bearing against a stop member 97, engageable with a shoulder 98 formed as a cam on the hinge 18 of the inner door 1. The jamb 3 is provided with extensions of bores 99 and 100 in the housings thereof for the rods 90 and 95, respectively.

Figure 14:
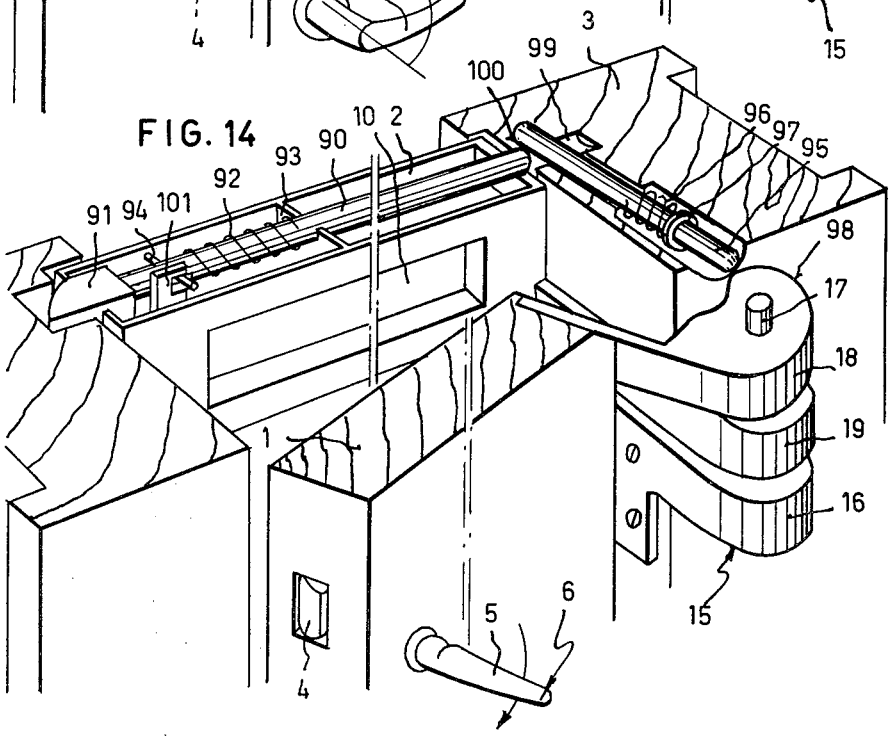
FIG. 14 is a view similar to FIG. 13, showing the position wherein the inner door is open and the outer door is completely blocked.
Figure 15:
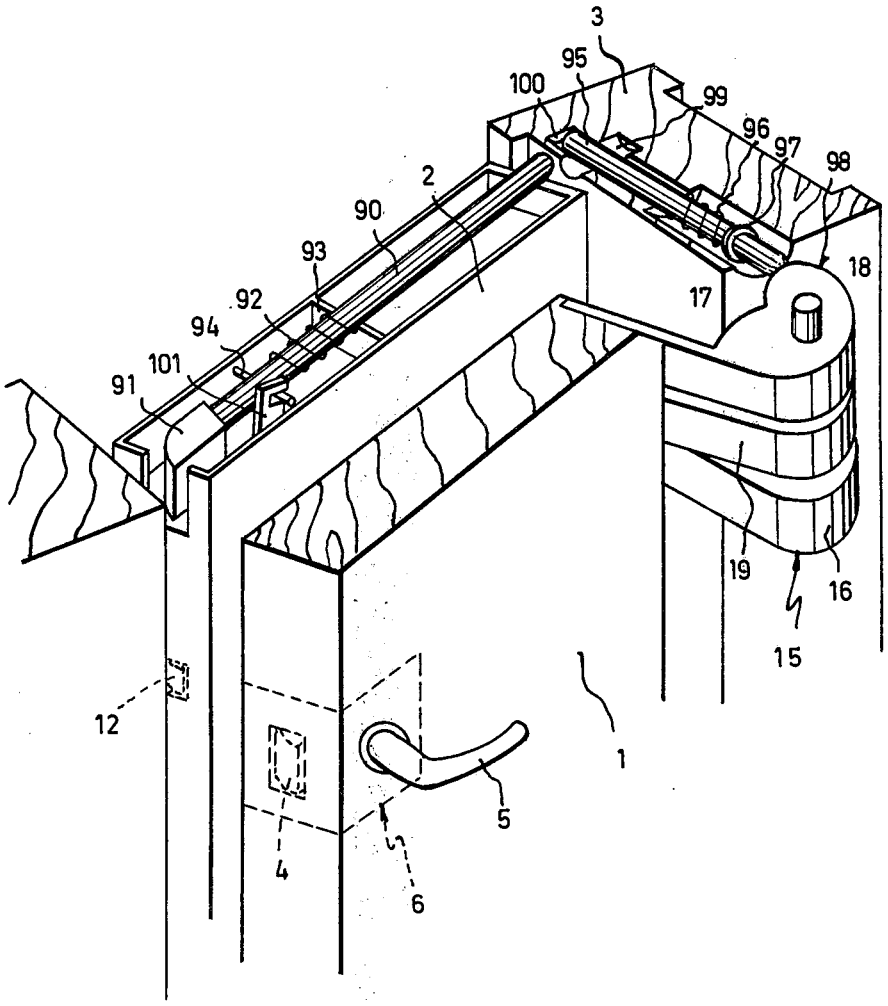
FIG. 15 is a view similar to FIG. 13, illustrating the joint opening of both doors forming the security door arrangement.

As shown in FIG. 13, when both doors 1 and 2 are closed, the rods 90 and 95 are in the forward position biassed by the respective springs 92 and 96 thereof. If the inner door 1 is opened by the handle 5 or lock 53, see FIG. 14, the rod 95 is pushed towards the bore 100 and intercepts the reverse movement of the rod 90, namely, the latch 91 is retained in its closed position and the outer door 2 may not be opened, even when the locking elements are forced or the coupling means, in this case the rod 14, are tampered with.

The outer door 2 blocking mechanism is applicable to prevent the person located on the outside of the outer door 2 from being able to force the outer door by manipulating the coupling means 6 when the inner door 1 is open.

When the combined door is opened, since the two doors are properly coupled together and the respective latches 4 and 12 being withdrawn at the same time as the possible auxiliary latches 91 are withdrawn by a control lever 101, the rod 90 penetrates in the bore 99, whereby the combined door may be opened, by rotation on the hinges 15. The shoulder 98 gradually pushes the rod 95 which does not interfere with the rod 90 because the latter is leaving the bore 99 with the rotation of the door, leaving room for the passage of the rod 95 into the bore 100.

As will be seen, the security door arrangement of the present invention attains all the security conditions proposed. A further condition to be covered is the case of small children trying to open the doors 1 and 2 hastily from the inside, on a call being heard, that is, without taking the inherent precautions. This is covered by locating the control members, namely, the lever 70 of the interlocking means 7, or equivalent member, at a height not directly within the reach of such young children.

What we claim is:

1. Personal security door arrangement, characterised in that there is disposed in a fixed door frame a conventional inner door juxtaposed to an outer protective door affording complete visibility therethrough and allowing the passage of small objects, said doors being hingedly mounted to the door frame at the same side, rotating in the same direction and each having its own lock and having:

(a) mutual coupling means for the two doors, with actuating means for the outer door from the inner door, interlockable by hand and automatically releasable on closing the door, which means, after the inner door has been opened to permit observation and has been of necessity closed again, are actuated voluntarily, thereby opening and retaining the outer door lock and opening both doors together;

(b) interlocking means for the coupling means mounted in the inner door;

(c) retaining means holding both doors coupled together in the open position;

(d) releasing means automatically disengaging both doors on their being closed; and (e) an outer door blocking means, blocking the bolts thereof when the inner door is open.

2. The security door arrangement of claim 1, characterised in that the door coupling means comprises a shaft crossing through the inner door and having a control actuatable from the inside and a terminal portion with a radially extending arm on the outside facing and penetrating in an orifice having a radially extending notch in the outer door, which terminal portion, on penetrating in the said orifice, engages a lever actuating the said outer door lock.

3. The security door arrangement of claim 1 or 2, characterised in that the inner door coupling means interlocking means comprises a control adapted to act on a double catch finger device mounted on the coupling means shaft, one of said catch fingers engaging a lever coupled to a lock capable of being opened from the outside by the corresponding key, said control activating the coupling means at will.

4. The security door arrangement of claim 3, characterised in that the retaining means comprises a rocking lever having a cam tooth actuatable by the releasing means and which engages the inner door interlocking means double catch finger device, thereby setting said catch fingers in the door coupling operative position.

5. The security door arrangement of claim 1, characterised in that the releasing means comprises a member which, by the closing movement of the inner door, inactivates the retaining means, thereby releasing the coupling means.

6. The security door arrangement of claim 1, characterised in that the releasing means comprises a rod disposed in the inner door, having a spring biassing the rear end thereof in engagement with the door jamb, and being provided at the front end thereof with a crank carrying a pawl acting on the retaining means rocking lever cam only when said door is being closed, in which case the rod moves forward and inactivates said rocking lever with respect to the interlocking means catch finger device.

7. The security door arrangement of claims 1 or 2, characterised in that the coupling means shaft terminal portion is provided with a recess in which there is insertable a rotatable rod of the outer door lock, the rotation of said rod causing opening of said lock from the inner door.

8. The security door arrangement of claim 1, characterised in that the outer door blocking means comprises one or more latch bolts attached to an operating member mounted in the door and a further operating member blocking member mounted on the hinge bearing jamb of the door frame and engaging an inner door hinge portion, said blocking member being pushed, when the inner door is opened, by said hinge portion thereby blocking said outer door operating member and preventing the latches thereof from being opened.

9. The security door arrangement of claim 1 or 8, characterised in that the outer door blocking means comprises an operating member constituted by a rod attached to one or more latch bolts and having a biassing spring and mating with a bore in the hinge bearing jamb of the door frame, there being mounted in the same jamb a blocking member constituted by a further rod perpendicular to the former and having a spring biassing it against the inner door moving hinge portion and mating with a rear bore in the frame, the said moving hinge portion having a cam portion which, in the open position of the inner door, bears against the said rod, preventing movement of the outer door.

* * * * *